US008531096B2

(12) United States Patent
Son et al.

(10) Patent No.: US 8,531,096 B2
(45) Date of Patent: Sep. 10, 2013

(54) FIELD EMISSION DEVICE AND METHOD OF MANUFACTURING THE SAME

(75) Inventors: Yoon-chul Son, Hwaseong-si (KR); Yong-chul Kim, Seoul (KR); In-taek Han, Seoul (KR); Ho-suk Kang, Seoul (KR)

(73) Assignee: Samsung Electronics Co., Ltd. (KR)

( * ) Notice: Subject to any disclaimer, the term of this patent is extended or adjusted under 35 U.S.C. 154(b) by 270 days.

(21) Appl. No.: 12/479,361

(22) Filed: Jun. 5, 2009

(65) Prior Publication Data

US 2010/0164356 A1 Jul. 1, 2010

(30) Foreign Application Priority Data

Dec. 26, 2008 (KR) ..... 10-2008-0134971

(51) Int. Cl.
*H01J 1/02* (2006.01)

(52) U.S. Cl.
USPC ..... 313/309; 313/495

(58) Field of Classification Search
USPC ..... 313/309, 311, 495–497, 351; 348/725
See application file for complete search history.

(56) References Cited

U.S. PATENT DOCUMENTS

| | | | | |
|---|---|---|---|---|
| 2001/0025962 | A1 | 10/2001 | Nakamoto | |
| 2005/0009694 | A1 * | 1/2005 | Watts et al. | 502/304 |
| 2006/0017363 | A1 * | 1/2006 | Wei et al. | 313/311 |
| 2006/0135030 | A1 * | 6/2006 | Mao | 445/50 |
| 2006/0175950 | A1 * | 8/2006 | Itou et al. | 313/311 |
| 2007/0196564 | A1 * | 8/2007 | Yagi et al. | 427/77 |
| 2010/0164355 | A1 * | 7/2010 | Son et al. | 313/309 |

FOREIGN PATENT DOCUMENTS

| | | | |
|---|---|---|---|
| KR | 1020030088063 | A | 11/2003 |
| KR | 1020070001769 | A | 1/2007 |

* cited by examiner

*Primary Examiner* — Anh Mai
*Assistant Examiner* — Brenitra M Lee
(74) *Attorney, Agent, or Firm* — Cantor Colburn LLP

(57) ABSTRACT

A field emission device includes; a substrate including at least one groove, at least one metal electrode disposed respectively in the at least one groove, and carbon nanotube ("CNT") emitters disposed respectively on the at least one metal electrode, wherein each of the CNT emitters includes a composite of Sn and CNTs.

6 Claims, 9 Drawing Sheets

FIELD EMISSION DEVICE AND METHOD OF MANUFACTURING THE SAME

CROSS-REFERENCE TO RELATED APPLICATION

This application priority to Korean Patent Application No. 10-2008-0134971, filed on Dec. 26, 2008, and all the benefits accruing therefrom under 35 U.S.C. §119, the contents of which in its entirety are herein incorporated by reference.

BACKGROUND

1. Field

One or more exemplary embodiments relate to a field emission device and a method of manufacturing the same.

2. Description of the Related Art

Field emission devices emit electrons from emitters formed on cathodes by forming a strong electric field around the emitters. Such field emission devices may be representatively applied to field emission displays ("FEDs"), which display images by the collision of electrons emitted from a field emission device with a phosphor layer formed on anodes, backlight units ("BLUs") of liquid crystal displays ("LCDs"), and the like.

LCDs display images on a front surface thereof by passing light, generated from a light source installed on a rear surface, through a liquid crystal layer which controls light transmittance therethrough. Examples of the light source installed on the rear surface of the LCD may include a cold cathode fluorescence lamp ("CCFL") BLU, a white light emitting diode ("WLED") BLU, a field emission BLU, and various other similar devices. The CCFL BLU provides color reproducibility and is manufactured at low costs. However, since the CCFL BLU uses the element mercury (Hg), the CCFL BLU may pollute the environment and may not increase brightness and contrast. The WLED BLU is dynamically controlled, however it incurs high manufacturing costs and has a complicated structure. The field emission BLU is locally dimmed and impulse/scan-driven to thereby maximize brightness, contrast, and the quality of motion pictures. Thus, the field emission BLU is expected to become widely used as a next-generation BLU. The field emission devices may also be applied to other various systems using electron emission, such as, X-ray tubes, microwave amplifiers, flat lamps, and other similar devices.

Micro tips formed of metal such as molybdenum (Mo) have been used as emitters which emit electrons in a field emission device. However, in recent years, carbon nanotubes ("CNTs") that provide good electron emission characteristics are becoming more widely used as emitters of a field emission device. Field emission devices using CNT emitters are driven with a low voltage, and have good chemical and mechanical stabilities.

Since such field emission devices are currently manufactured by performing photo patterning and firing several times, the manufacturing thereof is complicated and incurs heavy expenses. More specifically, metal electrodes such as cathodes may be roughly formed in two ways. In the first way, chromium (Cr), molybdenum (Mo), or the like is deposited by vacuum deposition and then patterned by photolithography. In the second way, silver (Ag), or other similar elements, is stencil-printed and then fired. However, the first method requires vacuum deposition equipment and is complicated, and in the second method, an expensive material is used, and thus, field emission devices are manufactured at high costs.

SUMMARY

One or more exemplary embodiments include a field emission device and a method of manufacturing the same.

Additional aspects, advantages and features will be set forth in part in the description which follows and, in part, will be apparent from the description, or may be learned by practice of the presented exemplary embodiments.

One exemplary embodiment of a field emission device includes; a substrate including at least one groove, at least one metal electrode respectively disposed on a bottom surface of the at least one groove, and carbon nanotube ("CNT") emitters respectively disposed on the at least one metal electrode and including a composite of Sn and CNTs.

In one exemplary embodiment, the CNT emitters may further include intermetallic compound layers respectively disposed on the at least one metal electrode.

In one exemplary embodiment, each of the intermetallic compound layers may include Sn and a material which is used to form the at least one metal electrode. In one exemplary embodiment, the intermetallic compound layers may further include Cu.

In one exemplary embodiment, the at least one metal electrode may include at least one material selected from the group consisting of Ni, Co, Cu, Au, Ag, and any mixture thereof.

In one exemplary embodiment, a field emission device includes; a substrate, an insulation layer disposed on the substrate and including at least one groove, wherein the at least one groove exposes a surface of the substrate, at least one metal electrode disposed on the surface of the substrate which is exposed via the at least one groove, and CNT emitters respectively disposed on the at least one metal electrode and including a composite of Sn and CNTs.

In one exemplary embodiment a method of manufacturing a field emission device includes; forming at least one groove in a substrate, disposed at least one metal electrode respectively on a bottom surface of the at least one groove, and disposing a composite of Sn and CNTs on the at least one metal electrode.

In one exemplary embodiment, the method may further include forming intermetallic compound layers respectively on the at least one metal electrode by firing the composite, after the operation of forming the composite of Sn and CNTs. In one exemplary embodiment, the composite may be fired in the range of about 250° C. to about 600° C.

In one exemplary embodiment, the at least one metal electrode may be disposed on the bottom surface of the at least one groove by electroless plating. In one exemplary embodiment, the metal electrodes may include at least one material selected from the group consisting of Ni, Co, Cu, Au, Ag, and any mixture thereof.

In one exemplary embodiment, the method may further include respectively forming seed layers on the bottom surface of the at least one groove to facilitate the electroless plating.

In one exemplary embodiment, the disposing of the composite on the at least one metal electrode may include plating an upper surface of the at least one metal electrode with the composite of Sn and CNTs using an Sn plating solution in which the CNTs are distributed.

In one exemplary embodiment, the disposing of the composite on the at least one metal electrode may include plating an upper surface of the at least one metal electrode respectively with Cu layers; and disposing the composite of Sn and CNTs on the at least one metal electrode while the Cu layers are displacement-plated with Sn.

In one exemplary embodiment a method of manufacturing a field emission device includes; disposing a metal layer on a substrate, forming at least one metal electrode by patterning the metal layer, disposing an insulation layer on the substrate to cover the at least one metal electrode, patterning the insulation layer to form at least one groove which exposes the at least one metal electrode, and disposing a composite of Sn and CNTs on the at least one metal electrode which is exposed via the at least one groove.

In one exemplary embodiment, the method may further forming at least one intermetallic compound layer on the at least one metal electrode by firing the composite.

According to the one or more of the above exemplary embodiments, metal electrodes are formed on a substrate by electroless plating, and thus, vacuum deposition and exposure do not need to be performed. Consequently, the costs for manufacturing the field emission devices of the one or more of the above embodiments are reduced. In addition, since CNTs are easily exposed to the outside due to a firing process, a special CNT activation process is not needed.

BRIEF DESCRIPTION OF THE DRAWINGS

These and/or other aspects, advantages and features will become apparent and more readily appreciated from the following description of the exemplary embodiments, taken in conjunction with the accompanying drawings of which.

DETAILED DESCRIPTION

Figure 1:
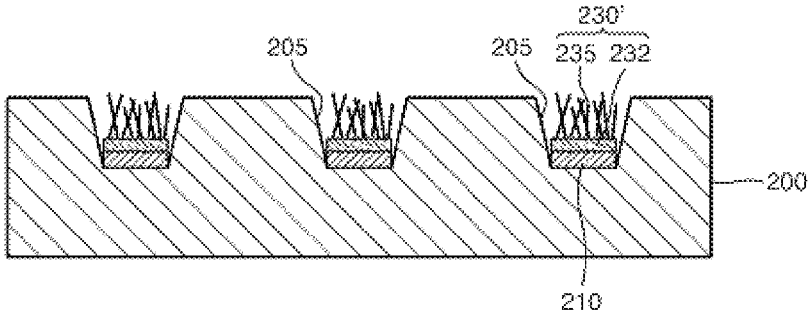
FIG. 1 is a cross-sectional view of an exemplary embodiment of a field emission device.

The invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another elements as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments of the present invention are described herein with reference to cross section illustrations that are schematic illustrations of idealized embodiments of the present invention. As such, variations from the shapes of the illustrations as a result, for example, of manufacturing techniques and/or tolerances, are to be expected. Thus, embodiments of the present invention should not be construed as limited to the particular shapes of regions illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present invention.

All methods described herein can be performed in a suitable order unless otherwise indicated herein or otherwise clearly contradicted by context. The use of any and all examples, or exemplary language (e.g., "such as"), is intended merely to better illustrate the invention and does not pose a limitation on the scope of the invention unless otherwise claimed. No language in the specification should be construed as indicating any non-claimed element as essential to the practice of the invention as used herein.

Hereinafter, the present invention will be described in detail with reference to the accompanying drawings.

FIG. 1 is a cross-sectional view of an exemplary embodiment of a field emission device. Referring to FIG. 1, the current exemplary embodiment of a field emission device includes a substrate 200 in which at least one groove 205 is formed, and metal electrodes 210 and carbon nanotube ("CNT") emitters 230' which are respectively formed in the grooves 205.

Exemplary embodiments of the substrate 200 include a glass substrate, although alternative exemplary embodiments include a plastic substrate or other similar materials. The grooves 205 are formed in the substrate 200 to have a predetermined depth. The grooves 205 may be formed substantially parallel to one another, for example, as strips, in the substrate 200.

Figure 7:
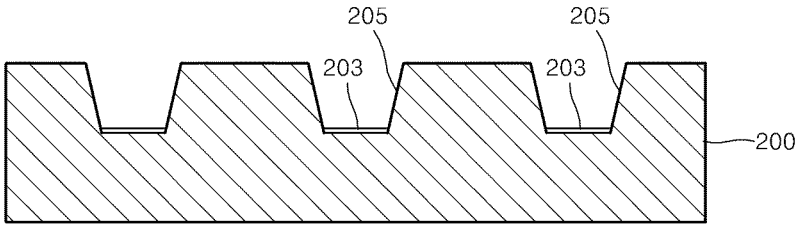

The metal electrodes 210 are formed on bottom surfaces of the grooves 205. The metal electrodes 210 correspond to cathodes. The metal electrodes 210 may be formed of a material selected from the group consisting of nickel (Ni), cobalt (Co), copper (Cu), gold (Au), silver (Ag), other materials with similar characteristics and any mixture thereof. In one exemplary embodiment, the metal electrodes 210 may be formed by electroless plating, as described later. Although not shown in FIG. 1, seed layers (see seed layers 203 of FIG. 7) may be further formed between the bottom surfaces of the grooves 205 and the metal electrodes 210. The seed layers facilitate the electroless plating for the metal electrodes 210, and may include a material selected from the group consisting of palladium (Pd), tin (Sn), a Pd—Sn alloy, dimethylamine borane ("DMAB"), other materials with similar characteristics and any mixture thereof.

The CNT emitters 230' are respectively formed on the metal electrodes 210 and are used for electron emission. In the present exemplary embodiment, each of the CNT emitters 230' includes a composite of Sn 232 and CNTs 235. The content of the CNTs 235 in the composite may be between about 20 volume % and about 90 volume %. The CNTs 235 may be formed so as to be exposed to the outside of the composite, e.g., they may be formed on top of a layer of Sn as shown in FIG. 1. The composite may further include a metal selected from the group consisting of Ag, Cu, tungsten (W), molybdenum (Mo), Co, titanium (Ti), zirconium (Zr), zinc (Zn), vanadium (V), chromium (Cr), iron (Fe), niobium (Nb), rhenium (Re), manganese (Mn), other materials with similar characteristics and any mixture thereof. In the present exemplary embodiment, the content of the metal further included in the composite may be less than or equal to about 5 wt %. The CNT emitters 230' may be formed by plating upper surfaces of the metal electrodes 210 with the composite of the Sn 232 and the CNTs 235 using an Sn plating solution in which the CNTs 235 are distributed.

Figure 2:
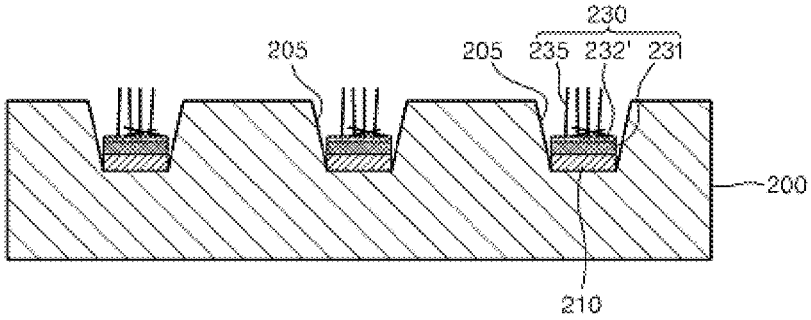
FIG. 2 is a cross-sectional view of another exemplary embodiment of a field emission device.

FIG. 2 is a cross-sectional view of another exemplary embodiment of a field emission device. The exemplary embodiment of a field emission device of FIG. 2 will now be described in terms of its difference with the previous exemplary embodiment of a field emission device shown in FIG. 1.

Referring to FIG. 2, the current exemplary embodiment of a field emission device includes the substrate 200 in which the at least one groove 205 is formed, and the metal electrodes 210 and CNT emitters 230 which are respectively formed in the grooves 205. The metal electrodes 210 correspond to cathodes. The metal electrodes 210 may be formed of a material selected from the group consisting of Ni, Co, Cu, Au, Ag, other materials with similar characteristics and any mixture thereof. Seed layers (not shown) may be further formed between the bottom surfaces of the grooves 205 and the metal electrodes 210 in order to facilitate electroless plating performed to form the metal electrodes 210.

The CNT emitters 230 are respectively formed on the metal electrodes 210 and are used for electron emission. Differing from the previous exemplary embodiment, in the present exemplary embodiment, each of the CNT emitters 230 includes an intermetallic compound layer 231 formed on the metal electrode 210, and the CNT emitters 230 are formed on the intermetallic compound layer 231. Exemplary embodiments of the intermetallic compound layer 231 may be formed of an intermetallic compound that includes Sn and a material used to form the metal electrodes 210. In one exemplary embodiment, the intermetallic compound layer 231 may be formed of a ternary intermetallic compound obtained by adding Cu to the intermetallic compound.

In one exemplary embodiment, the intermetallic compound layer 231 may be formed by firing the composite of the Sn 232 and the CNTs 235 illustrated in FIG. 1 at a predetermined temperature. Due to the firing process, the CNTs 235 may be more exposed to the outside than the CNTs 235 of FIG. 1, which are not formed by firing, as will be described later in greater detail. When the intermetallic compound layer 231 is formed of a part of the Sn 232 of FIG. 1, which melts, an Sn layer 232' may be formed on the intermetallic compound layer 231. Although not shown in FIGS. 1 and 2, a gate electrode (not shown) for electron extraction may be further formed on portions of the upper surface of the substrate 200, which are in between the grooves 205.

Figure 3:
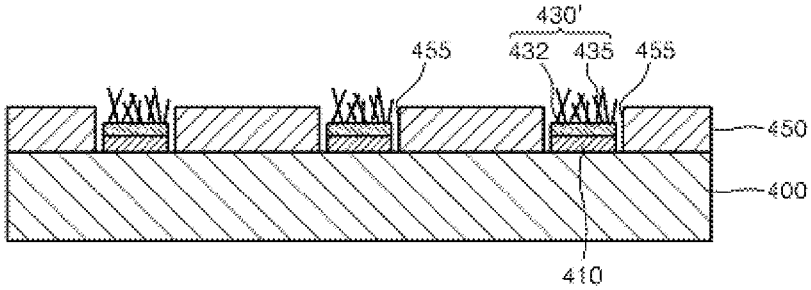
FIG. 3 is a cross-sectional view of another exemplary embodiment of a field emission device.

FIG. 3 is a cross-sectional view of another exemplary embodiment of a field emission device. The exemplary embodiment of a field emission device of FIG. 3 will now be described in terms of its differences with the previous exemplary embodiments of field emission devices of FIGS. 1 and 2.

Referring to FIG. 3, the current exemplary embodiment of a field emission device includes a substrate 400, an insulation layer 450 in which at least one groove 455 is formed, and metal electrodes 410 and CNT emitters 430' which are respectively formed in the grooves 455.

The insulation layer 450 is formed on the substrate 400 to have a predetermined thickness, and includes the grooves 455 which expose portions of the top surface of the substrate 400, e.g., in one exemplary embodiment the grooves 455 correspond to areas where the insulation layer 450 has been entirely removed. The metal electrodes 410 are formed on the exposed portions of the surface of the substrate 400. As described above, the metal electrodes 410 may be formed of one material selected from the group consisting of Ni, Co, Cu, Au, Ag, materials with similar characteristics and any mixture thereof. Although not shown in FIG. 3, seed layers may be further formed between the exposed portions of the top surface of the substrate 400 and the metal electrodes 410.

The CNT emitters 430' are respectively formed on the metal electrodes 410 and are used for electron emission. Each of the CNT emitters 430' includes a composite of Sn 432 and CNTs 435. The content of the CNTs 435 in the composite may be between about 20 volume % and about 90 volume %. The CNTs 435 may be formed so as to be exposed to the outside of the composite. As described above, the CNT emitters 430' may be formed by plating upper surfaces of the metal electrodes 410 with the composite of the Sn 432 and the CNTs 435 using an Sn plating solution in which the CNTs 435 are distributed.

Figure 4:
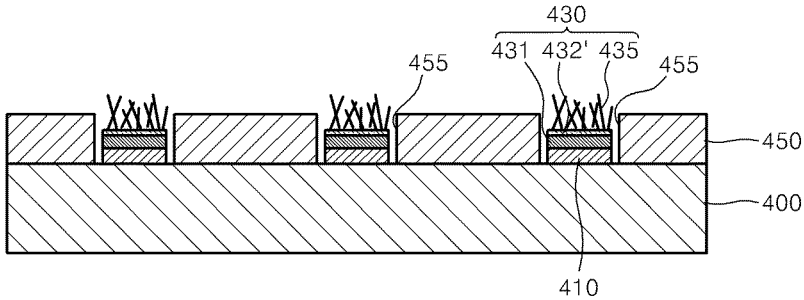
FIG. 4 is a cross-sectional view of another exemplary embodiment of a field emission device.

FIG. 4 is a cross-sectional view of another exemplary embodiment of a field emission device. The exemplary embodiment of a field emission device of FIG. 4 will now be described in terms of its differences with the previous exemplary embodiments of field emission devices of FIGS. 1 to 3.

Referring to FIG. 4, the current exemplary embodiment of a field emission device includes the substrate 400, the insulation layer 450 in which the at least one groove 455 is formed, and the metal electrodes 410 and the CNT emitters 430' which are respectively formed in the grooves 455. The insulation layer 450 is formed on the substrate 400 to have a predetermined thickness, and includes the grooves 455 which expose portions of the top surface of the substrate 400. The metal electrodes 410 are respectively formed on the exposed portions of the top surface of the substrate 400.

The CNT emitters 430 are respectively formed on the metal electrodes 410 and are used for electron emission. Each of the CNT emitters 430 includes an intermetallic compound layer 431 formed on the metal electrode 410, and the CNTs 435 formed on the intermetallic compound layer 431. The intermetallic compound layer 431 may be formed of an intermetallic compound that includes Sn and a material used to form the metal electrodes 410. The intermetallic compound layer 431 may be formed of a ternary intermetallic compound obtained by adding Cu to the intermetallic compound. The intermetallic compound layer 431 may be formed by firing the composite of the Sn 432 and the CNTs 435, which is illustrated in FIG. 3, at a predetermined temperature. Due to the firing process, the CNTs 435 may be more exposed to the outside than the CNTs 435 of FIG. 3, which are not formed in a firing process, as will be described later in greater detail. When the intermetallic compound layer 431 is formed of a partially melted portion of the Sn 432 of FIG. 3, an Sn layer 432' may remain on the intermetallic compound layer 431. Although not shown in FIGS. 3 and 4, a gate electrode (not shown) for electron extraction may be further formed on portions of the upper surface of the substrate 400, which are in between the grooves 455.

Exemplary embodiments of methods of manufacturing the aforementioned exemplary embodiments of field emission devices will now be described. FIGS. 5 through 10 are cross-sectional views illustrating an exemplary embodiment of a method of manufacturing an exemplary embodiment of a field emission device.

Figure 5:
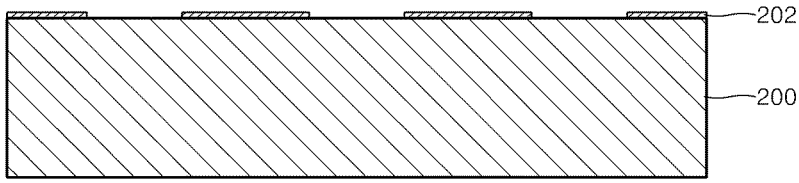
FIGS. 5 through 10 are cross-sectional views illustrating an exemplary embodiment of a method of manufacturing an exemplary embodiment of a field emission device.

Referring to FIG. 5, first, a substrate 200 is prepared. Exemplary embodiments of the substrate 200 may include one of glass, plastic, other materials having similar characteristics, or a combination thereof. Then, an etch mask 202 having a predetermined pattern is formed on the substrate 200. The etch mask 202 may be formed by forming a material layer on the upper surface of the substrate 200 and patterning the material layer.

Figure 6:
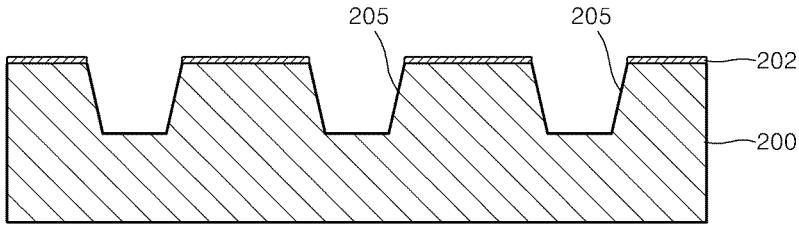

Referring to FIG. 6, portions of the upper surface of the substrate 200, which are exposed via the etch mask 202, are subject to, for example, etching or sand blasting, thereby forming the grooves 205 having a predetermined depth. Alternative exemplary embodiments include alternative methods of groove formation. Next, referring to FIG. 7, seed layers 203 may be respectively formed on the bottom surfaces of the grooves 205 to facilitate electroless plating that is later performed to form metal electrodes 210. The seed layers 203 may include one material selected from the group consisting of Pd, Sn, a Pd—Sn alloy, DMAB, other materials having similar characteristics and any mixture thereof. The seed layers 203 may be formed by coating a solution including a material selected from the group consisting of Pd, Sn, a Pd—Sn alloy, DMAB, other materials having similar characteristics and any mixture thereof over the structure of FIG. 6 and then removing the etch mask 202. Exemplary embodiments of the formation of the coating may include dipping, stencil printing, inkjet printing or other similar methods.

Figure 8:
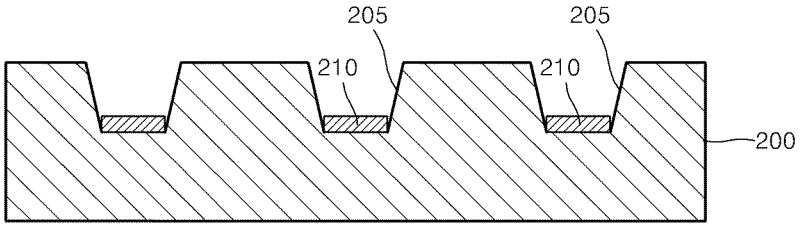

Referring to FIG. 8, the metal electrodes 210 are respectively formed on the seed layers 203. In one exemplary embodiment, the metal electrodes 210 may be formed by electroless plating. For the sake of convenience, the seed layers 203 are not shown in FIG. 8, and likewise in the following figures. The metal electrodes 210 may be formed of a material selected from the group consisting of Ni, Co, Cu, Au, Ag, other materials having similar characteristics and any mixture thereof. For example, in one exemplary embodiment wherein the metal electrodes 210 are formed of Ni, phosphorus (P) or boron (B) may be added to the Ni. For example, in one exemplary embodiment wherein the metal electrodes 210 are formed of Co, P may be added to the Co.

Figure 9:
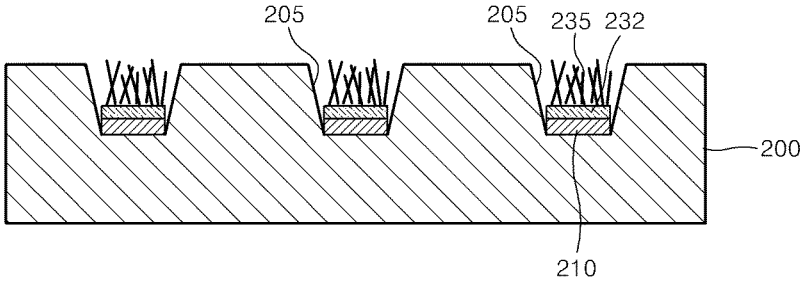

Referring to FIG. 9, a composite of Sn 232 and CNTs 235 is formed on the metal electrodes 210. The content of the CNTs 235 in the composite may be between about 20 volume % and about 90 volume %. The Sn 232 has a melting point of about 232° C. The composite may further include, in addition to the Sn 232, a metal material selected from the group consisting of Ag, Cu, W, Mo, Co, Ti, Zr, Zn, V, Cr, Fe, Nb, Re, Mn, other materials having similar characteristics and any mixture thereof. In such an exemplary embodiment, the content of the metal material further included in the composite may be equal to or less than about 5 weight %. In one exemplary embodiment, the composite of the Sn 232 and the CNTs 235 may be formed by electroless plating using a Sn plating solution in which the CNTs 235 are distributed. Alternative exemplary embodiments include configurations wherein the CNTs 235 may be formed by electroplating or other similar methods. When the composite of the Sn 232 and the CNTs 235 is formed as described above, if the CNTs 235 are properly exposed to the outside of the composite, the composite itself may serve as the CNT emitters 230' of FIG. 1, without undergoing a firing process which is described later. However, if the CNTs 235 are not exposed to the outside of the composite, the firing process is performed.

Figure 10:
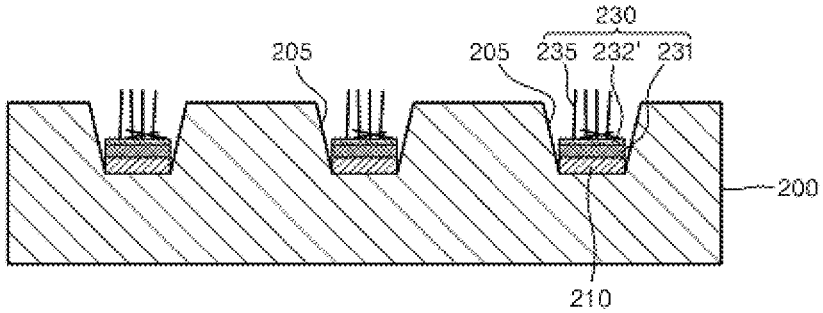

Referring to FIG. 10, the composite of the Sn 232 and the CNTs 235 formed on the metal electrodes 210 is fired at a predetermined temperature, thereby forming CNT emitters 230. The composite may be fired in the range of about 250° C. to about 600° C. When the composite is fired as described, the Sn 232 of the composite reacts with the material used to form the metal electrodes 210, thereby forming intermetallic compound layers 231 respectively on the metal electrodes 210. The exposed CNTs 235 are formed on the intermetallic compound layers 231. More specifically, when the composite is fired at a predetermined temperature, the Sn 232 included in the composite melts and moves downward. The melted Sn 232 reacts with the material used to form the metal electrodes 210, thereby forming the intermetallic compound layers 231. For example, in one exemplary embodiment wherein the metal electrodes 210 are formed of electroless-plated Ni, the intermetallic compound layers 231 may be formed of an intermetallic compound including Sn and Ni, for example, $Ni_3Sn_4$. As described above, the Sn 232 included in the composite is melted and moved downward by the firing process, and thus the CNTs 235 included in the composite are naturally exposed to the outside of the composite due to the downward flow of the Sn from the upper portion of the composite. If a part of the Sn 232 included in the composite melts and forms the intermetallic compound layers 231, Sn layers 232' may be respectively formed on the intermetallic compound layers 231.

FIGS. 11 through 15 are cross-sectional views illustrating another exemplary embodiment of a method of manufacturing an exemplary embodiment of a field emission device.

Figure 11:
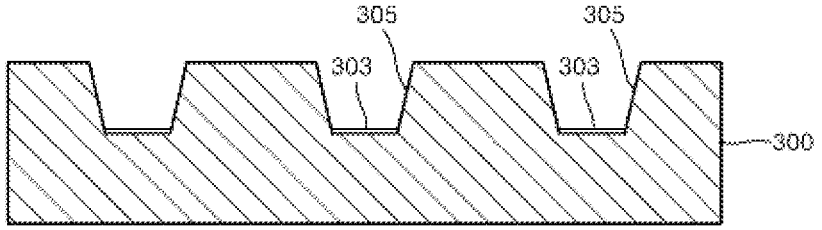
FIGS. 11 through 15 are cross-sectional views illustrating another exemplary embodiment of a method of manufacturing an exemplary embodiment of a field emission device.

Referring to FIG. 11, at least one groove 305 is formed on a substrate 300 to have a predetermined depth. More specifically, in one exemplary embodiment, an etch mask (not shown) is disposed on the upper surface of the substrate 300, and then portions of the upper surface of the substrate 300, which are exposed via the etch mask, are subject to, for example, etching or sand blasting, thereby forming the grooves 305 having a predetermined depth. Alternative exemplary embodiments include alternative methods of groove 305 formation. Next, seed layers 303 may be respectively formed on the bottom surfaces of the grooves 305. As described above, the seed layers 303 may include a material selected from the group consisting of Pd, Sn, a Pd—Sn alloy, DMAB, other materials having similar characteristics and any mixture thereof.

Figure 12:
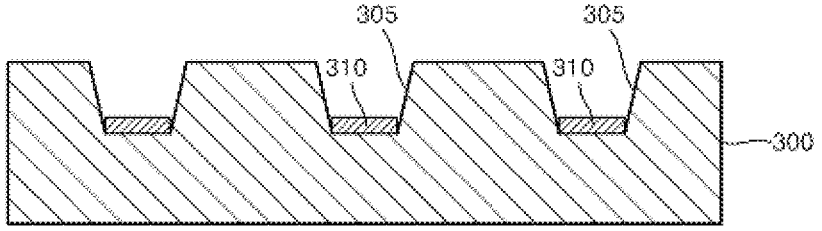
Figure 13:
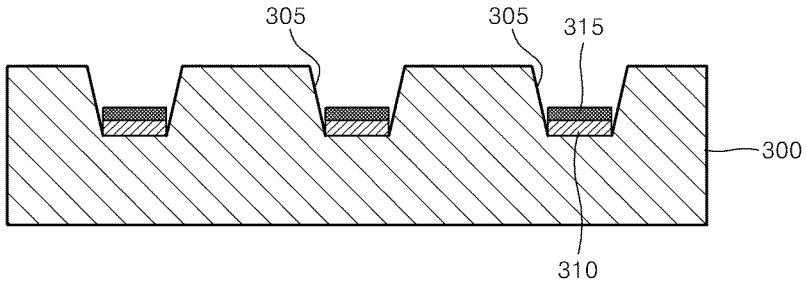

Referring to FIG. 12, metal electrodes 310 are respectively formed on the seed layers 303. In one exemplary embodiment, the metal electrodes 310 may be formed by electroless plating. The metal electrodes 310 may be formed of a material selected from the group consisting of Ni, Co, Cu, Au, Ag, other materials having similar characteristics and any mixture thereof. Referring to FIG. 13, Cu layers 315 are respectively formed on the metal electrodes 310. Exemplary embodiments include configurations wherein the Cu layers 315 may be formed by electroless plating or by electroplating.

Figure 14:
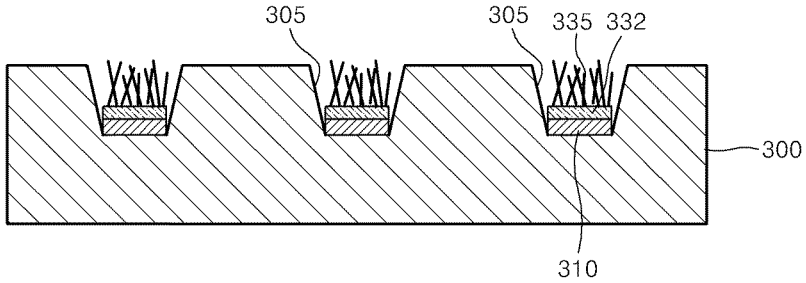

Referring to FIG. 14, in the present exemplary embodiment upper surfaces of the metal electrodes 310 are plated with a composite of Sn 332 and CNTs 335 by displacement plating. More specifically, the composite of the Sn 332 and the CNTs 335 may be formed on the metal electrodes 310 by displacement-plating the Cu layers 315 with Sn using a Sn plating solution in which the CNTs 335 are distributed. The content of the CNTs 335 in the composite may be between about 20 volume % and about 90 volume %. The composite may further include, in addition to the Sn 332, a metal material selected from the group consisting of Ag, Cu, W, Mo, Co, Ti, Zr, Zn, V, Cr, Fe, Nb, Re, Mn, other materials having similar characteristics and any mixture thereof. In such an exemplary embodiment, the content of the metal material further included in the composite may be equal to or less than about 5 weight %. When the composite of the Sn 332 and the CNTs 335 is formed as described above, if the CNTs 335 are properly exposed to the outside of the composite, the composite itself may serve as the CNT emitters 130' of FIG. 1, without undergoing a firing process which is described later. However, if the CNTs 335 are not exposed to the outside of the composite, the firing process is performed.

Figure 15:
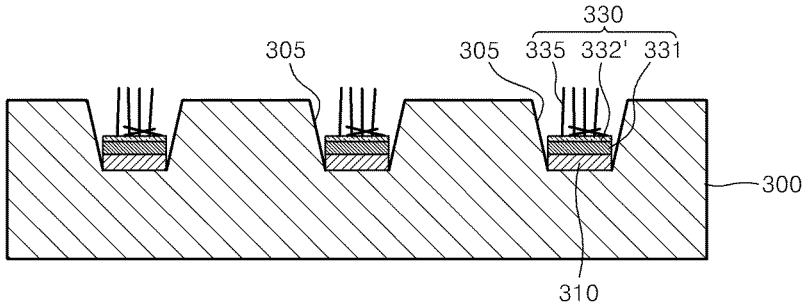

Referring to FIG. 15, the composite of the Sn 332 and the CNTs 335 formed on the metal electrodes 310 is fired at a predetermined temperature, thereby forming CNT emitters 330. The composite may be fired in the range of about 250° C. to about 600° C. When the composite is fired as described, the Sn 332 of the composite reacts with the material used to form the metal electrodes 310, thereby respectively forming intermetallic compound layers 331 on the metal electrodes 310. The exposed CNTs 335 are respectively formed on the intermetallic compound layers 331. More specifically, when the composite is fired at a predetermined temperature, the Sn 332 included in the composite melts and moves downward. The melted Sn 332 reacts with the material used to form the metal electrodes 310, thereby forming the intermetallic compound layers 331. For example, in the exemplary embodiment wherein the metal electrodes 310 are formed of electroless-plated Ni, the intermetallic compound layers 331 may be formed of an intermetallic compound including Sn and Ni, for example, $Ni_3Sn_4$. If Cu remains within the composite after the displacement plating is performed, the intermetallic compound layers 331 formed after the firing process may further include Cu, and thus, the intermetallic compound layers 331 may be formed of a ternary intermetallic compound. As described above, the Sn 332 included in the composite is melted and moved downward by the firing process, and thus, the CNTs 335 included in the composite are naturally exposed to the outside of the composite. If a part of the Sn 332 included in the composite melts and forms the intermetallic compound layers 331, Sn layers 332' may be respectively formed on the intermetallic compound layers 331.

FIGS. 16 through 21 are cross-sectional views illustrating another exemplary embodiment of a method of manufacturing an exemplary embodiment of a field emission device.

Figure 16:
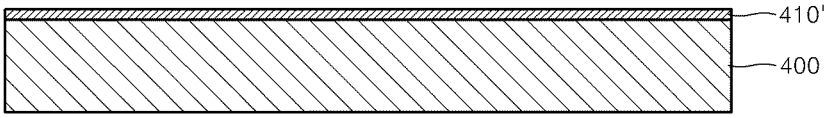
FIGS. 16 through 21 are cross-sectional views illustrating another exemplary embodiment of a method of manufacturing an exemplary embodiment of a field emission device.

Referring to FIG. 16, a substrate 400 is prepared, and then a metal layer 410' is formed on the substrate 400, in one exemplary embodiment the metal layer 401' may be formed by electroless plating. The metal layer 410' may be formed of a material selected from the group consisting of Ni, Co, Cu, Au, Ag, materials having similar characteristics and any mixture thereof. For example, in the exemplary embodiment wherein the metal layer 410' is formed of Ni, P or B may be added to the Ni. For example, in the exemplary embodiment wherein the metal layer 410 is formed of Co, P may be added to the Co. In one exemplary embodiment, a seed layer (not shown) may be formed on the upper surface of the substrate 400, before the metal layer 410' is formed, to facilitate electroless plating which is later performed to form the metal layer 410'. The seed layer may include a material selected from the group consisting of Pd, Sn, a Pd—Sn alloy, DMAB, other materials having similar characteristics and any mixture thereof.

Figure 17:
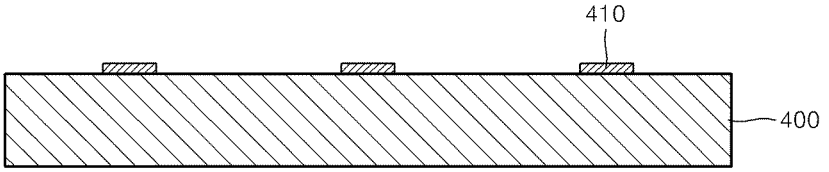
Figure 18:
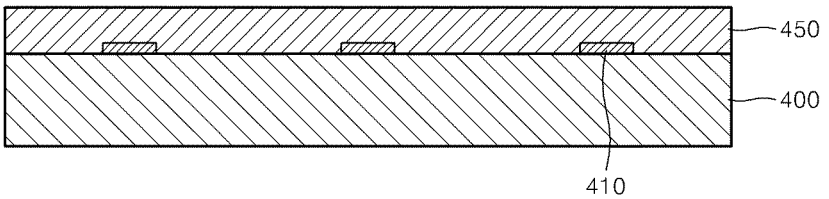
Figure 19:
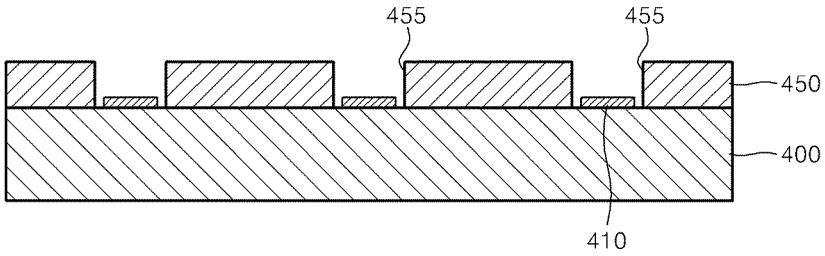

Referring to FIG. 17, the metal layer 410' is patterned to form at least one metal electrode 410 on the substrate 400. Referring to FIG. 18, an insulation layer 450 is formed on the substrate 400 to have a predetermined thickness so as to cover the metal electrodes 410. Next, referring to FIG. 19, the insulation layer 450 is patterned to form at least one groove 455 in the insulation layer 450 in order to expose the metal electrodes 410.

Figure 20:
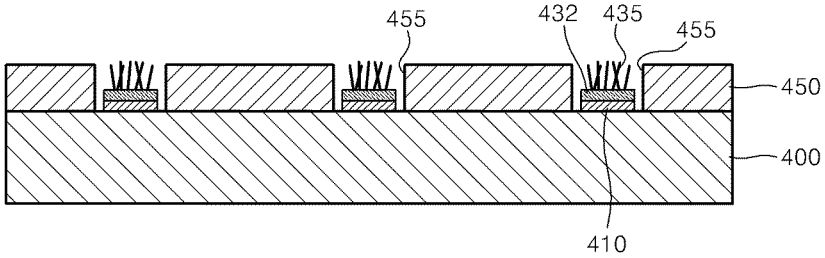

Referring to FIG. 20, a composite of Sn 432 and CNTs 435 is formed on the metal electrodes 410. In one exemplary embodiment, the content of the CNTs 435 in the composite may be between about 20 volume % and about 90 volume %. The Sn 232 has a melting point of about 232° C. The composite may further include, in addition to the Sn 432, a metal material selected from the group consisting of Ag, Cu, W, Mo, Co, Ti, Zr, Zn, V, Cr, Fe, Nb, Re, Mn, other materials having similar characteristics and any mixture thereof. In such an exemplary embodiment, the content of the metal material further included in the composite may be equal to or less than about 5 weight %. In one exemplary embodiment, the composite of the Sn 432 and the CNTs 435 may be formed by electroless plating using a Sn plating solution in which the CNTs 435 are distributed. Alternative exemplary embodiments include configurations wherein the CNTs 435 may be formed by electroplating. When the composite of the Sn 432 and the CNTs 435 is formed as described above, if the CNTs 435 are properly exposed to the outside of the composite, the composite itself may serve as CNT emitters, without undergoing a firing process which is described later. However, if the CNTs 435 are not exposed to the outside of the composite, the firing process is performed.

Figure 21:
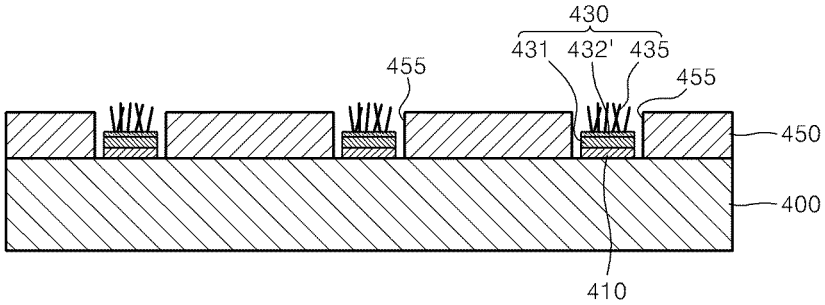

Referring to FIG. 21, the composite of the Sn 432 and the CNTs 435 formed on the metal electrodes 410 is fired at a predetermined temperature, thereby forming CNT emitters 430. The composite may be fired in the range of about 250° C. to about 600° C. When the composite is fired as such, the Sn 432 of the composite reacts with the material used to form the metal electrodes 410, thereby respectively forming intermetallic compound layers 431 on the metal electrodes 410. The exposed CNTs 435 are formed on the intermetallic compound layer 410. More specifically, when the composite is fired at a predetermined temperature, the Sn 432 included in the composite melts and moves downward. The melted Sn 432 reacts with the material used to form the metal electrodes 410, thereby forming the intermetallic compound layers 431. In the exemplary embodiment wherein the metal electrodes 410 are formed of electroless-plated Ni, the intermetallic compound layers 431 may be formed of an intermetallic compound including Sn and Ni, for example, $Ni_3Sn_4$. As described above, the Sn 432 included in the composite is melted and moved downward by the firing process, and thus, the CNTs 435 included in the composite are naturally exposed to the outside of the composite. If a part of the Sn 432 included in the composite melts and forms the intermetallic compound layers 431, Sn layers 432' may be respectively formed on the intermetallic compound layers 431.

FIGS. 22 through 25 are cross-sectional views illustrating another exemplary embodiment of a method of manufacturing an exemplary embodiment of a field emission device.

Figure 22:
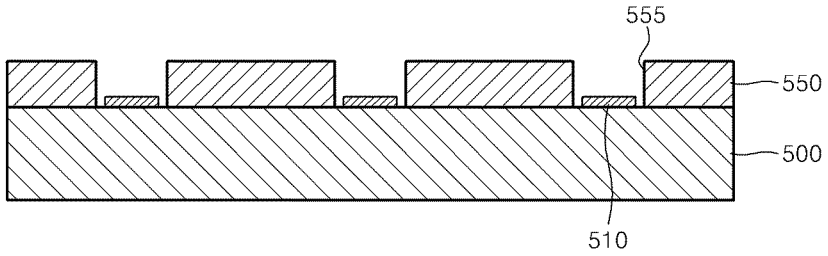
FIGS. 22 through 25 are cross-sectional views illustrating another exemplary embodiment of a method of manufacturing an exemplary embodiment of a field emission device.

Referring to FIG. 22, a metal layer (not shown) is formed on a substrate 500 by electroless plating, and then, is patterned so as to form at least one metal electrode 510 on the substrate 500, similar to the previous exemplary embodiment. Next, an insulation layer 550 is formed on the substrate 500 so as to cover the metal electrodes 510, and then, is patterned so as to form at least one groove 555 in the insulation layer 550 in order to expose the metal electrodes 510, similar to the previous exemplary embodiment.

Figure 23:
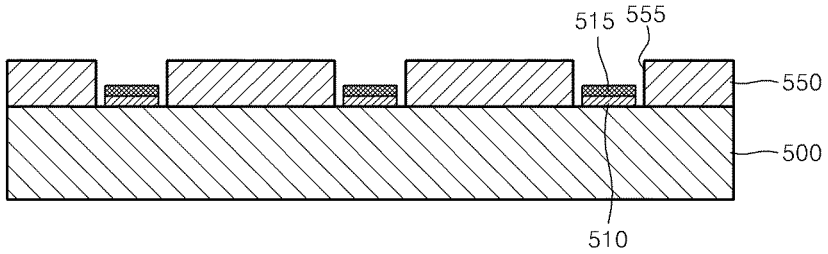
Figure 24:
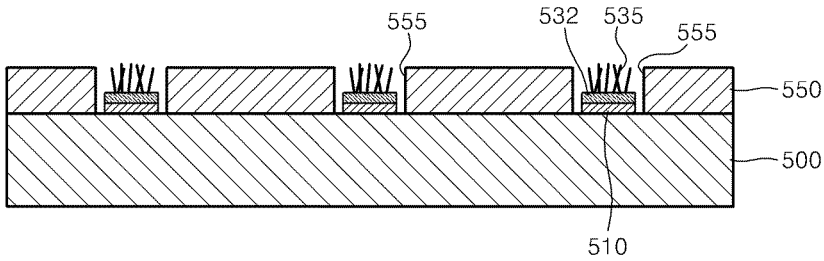

Referring to FIG. 23, Cu layers 515 are formed respectively on the metal electrodes 510. Exemplary embodiments include configurations wherein the Cu layers 515 may be formed by electroless plating or by electroplating or other similar methods. Referring to FIG. 24, upper surfaces of the metal electrodes 510 are plated with a composite of Sn 532 and CNTs 535 by displacement plating. More specifically, the composite of the Sn 532 and the CNTs 535 may be formed on the metal electrodes 510 by displacement-plating the Cu layers 515 with Sn using a Sn plating solution in which the CNTs 535 are distributed. In one exemplary embodiment, the content of the CNTs 535 in the composite may be between about 20 volume % and about 90 volume %. The composite may further include, in addition to the Sn 532, a metal material selected from the group consisting of Ag, Cu, W, Mo, Co, Ti, Zr, Zn, V, Cr, Fe, Nb, Re, Mn, other materials having similar characteristics and any mixture thereof. In such an exemplary embodiment, the content of the metal material further included in the composite may be equal to or less than about 5 weight %. When the composite of the Sn 532 and the CNTs 535 is formed as described above, if the CNTs 535 are properly exposed to the outside of the composite, the composite itself may serve as CNT emitters, without undergoing a firing process which is described later. However, if the CNTs 535 are not exposed to the outside of the composite, the firing process is performed.

Figure 25:
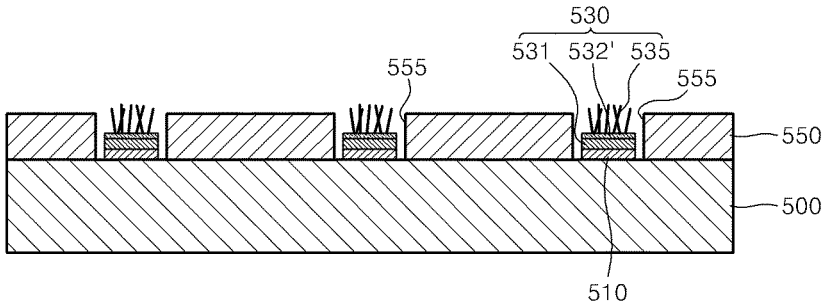

Referring to FIG. 25, the composite of the Sn 532 and the CNTs 535 formed on the metal electrodes 510 is fired at a predetermined temperature, thereby forming CNT emitters 530. The composite may be fired in the range of about 250° C. to about 600° C. When the composite is fired as described, the Sn 532 of the composite reacts with the material used to form the metal electrodes 510, thereby respectively forming intermetallic compound layers 531 on the metal electrodes 510. The exposed CNTs 535 are respectively formed on the intermetallic compound layers 531. More specifically, when the composite is fired at a predetermined temperature, the Sn 532 included in the composite melts and moves downward. The melted Sn 532 reacts with the material used to form the metal electrodes 510, thereby forming the intermetallic compound layers 531. In the exemplary embodiment wherein Cu remains in the composite after the displacement plating is performed, the intermetallic compound layers 531 formed after the firing process may further include Cu, and thus, the intermetallic compound layers 531 may be formed of a ternary intermetallic compound. As described above, the Sn 532 included in the composite is melted and moved downward by the firing process, and thus, the CNTs 535 included in the composite are naturally exposed to the outside of the composite. If a part of the Sn 532 included in the composite melts and forms the intermetallic compound layers 531, Sn layers 532' may be formed on the intermetallic compound layers 531.

As described above, according to the one or more of the above exemplary embodiments, metal electrodes are formed by electroless plating, and thus, vacuum deposition equipment and exposure equipment are not needed. Consequently, the costs for manufacturing the exemplary embodiments of field emission devices are reduced. In addition, upper surfaces of the metal electrodes are electroless-plated with a composite of Sn and CNTs, and thus, the CNTs are exposed to the outside of the composite. Moreover, since Sn has a low melting point and is easily oxidized, if firing is performed at a temperature equal to or greater than the melting point of Sn, the Sn is first oxidized within the composite. Thus, oxidization of the CNTs is prevented as much as possible, and thus, the firing may be performed even under an air atmosphere. Furthermore, while an intermetallic compound is formed by Sn melting and moving downward during the firing process, the CNTs are naturally exposed to the outside of the composite. Therefore, a special CNT activation process is not needed.

It should be understood that the exemplary embodiments described therein should be considered in a descriptive sense only and not for purposes of limitation. Descriptions of features or aspects within each embodiment should typically be considered as available for other similar features or aspects in other embodiments.

What is claimed is:

1. A field emission device comprising:

a substrate including at least one groove;

at least one metal electrode respectively disposed on a bottom surface of the at least one groove; and carbon nanotube emitters respectively disposed on the at least one metal electrode, wherein each of the carbon nanotube emitters comprises:

an intermetallic compound layer disposed on a surface of the at least one metal electrode; and an Sn layer disposed on the intermetallic compound layer; and carbon nanotube disposed on the Sn layer, wherein the intermetallic compound layer of each of the carbon nanotube comprises Sn and a material which is used to form the at least one metal electrode.

2. The field emission device of claim 1, wherein each of the intermetallic compound layer further comprises Cu.

3. The field emission device of claim 1, wherein the at least one metal electrode includes at least one material selected from the group consisting of Ni, Co, Cu, Au, Ag, and any mixtures thereof.

4. A field emission device comprising:

a substrate;

an insulation layer disposed on the substrate and comprising at least one groove, wherein the at least one groove exposes a surface of the substrate;

at least one metal electrode disposed on the surface of the substrate which is exposed via the at least one groove; and carbon nanotube emitters respectively disposed on the at least one metal electrode, wherein each of the carbon nanotube emitters comprises:

an intermetallic compound layer disposed on a surface of the at least one metal electrode; and an Sn layer; and carbon nanotube disposed on the Sn layer, wherein the intermetallic compound layer of each of the carbon nanotube emitters comprises Sn and a material which is used to form the at least one metal electrode.

5. The field emission device of claim 4, wherein the intermetallic compound layer of each of the carbon nanotube emitters further comprises Cu.

6. The field emission device of claim 4, wherein the at least one metal electrode includes at least one material selected from the group consisting of Ni, Co, Cu, Au, Ag, and any mixtures thereof.

* * * * *